US005436699A

United States Patent [19]

Komaki

[11] Patent Number: 5,436,699

[45] Date of Patent: Jul. 25, 1995

[54] PHOTOSENSITIVE DRUM EARTHING MECHANISM

[75] Inventor: Susumu Komaki, Osaka, Japan

[73] Assignee: Mita Industrial Co., Ltd., Osaka, Japan

[21] Appl. No.: 179,379

[22] Filed: Jan. 10, 1994

[30] Foreign Application Priority Data

Jan. 11, 1993 [JP] Japan ..... 5-002927

[51] Int. Cl.[6] ..... G03G 15/04; G03G 21/00

[52] U.S. Cl. ..... 355/211

[58] Field of Search ..... 355/200, 211, 212, 213

[56] References Cited

U.S. PATENT DOCUMENTS

| | | | |
|---|---|---|---|
| 4,839,690 | 6/1989 | Onoda et al. | 355/211 |
| 5,023,660 | 6/1991 | Ebata et al. | 355/200 |
| 5,128,715 | 7/1992 | Furuyama et al. | 355/200 |
| 5,210,574 | 5/1993 | Kita | 355/211 |
| 5,303,004 | 4/1994 | Maruyama et al. | 355/200 |

*Primary Examiner*—Fred L. Braun
*Attorney, Agent, or Firm*—Beveridge, DeGrandi, Weilacher & Young

[57] ABSTRACT

A photosensitive drum earthing mechanism includes an engaging clutch having a drive-side clutch member and a drum-side clutch member. The drum-side clutch member is fixed to an image carrier in a photosensitive drum and is connectable in a circumferential direction to the drive-side clutch member. The clutch members transmit torque to the image carrier. A conducting portion provided with the drum-side clutch member electrically connects the image carrier to a conductive portion of the drive-side clutch member. This conducting portion is disposed on an inner peripheral end of the image carrier and has a connecting projection which passes through the drum-side clutch member to engage engaging claws of the clutch members so that the connecting projection is electrically connected in the circumferential direction with the drive-side clutch member. The drum-side clutch member may include a flange portion made of an insulating material which is mounted on an inner periphery of the conductive image carrier and an engaging portion made of a conductive material which is electrically and mechanically connectable to a claw of the drive-side clutch member. A supporting pin made of metal may be used to align the drum-side clutch member and the drive-side clutch member. This supporting pin may rotatably slide contact the drive-side clutch member.

14 Claims, 5 Drawing Sheets

PHOTOSENSITIVE DRUM EARTHING MECHANISM

CROSS REFERENCE TO RELATED APPLICATION

This application claims priority benefits under 35 USC § 119 of Japanese Patent Application Ser. No. 5-2927, the disclosure of which is incorporated by reference.

BACKGROUND OF THE INVENTION

1. Field of the Invention

The present invention relates generally to a photosensitive drum earthing mechanism, and more particularly, to a photosensitive drum earthing mechanism which is most suitable for a photosensitive drum of such a type that power is transmitted through an engaging clutch to an image carrier formed of a cylindrical conductive member having an insulating layer on its whole surface.

2. Description of the Related Art

In general, the photosensitive drum of this type is widely used for an image forming section in an image forming apparatus for developing an electrostatic latent image into a toner image. In recent years, in order to unitize the image forming section, the image forming section is at least provided with a unit on which the photosensitive drum is detachably mounted. Such a photosensitive drum on the unit is engaged with a main body through clutch members so disposed respectively on the photosensitive drum and the main body as to connect or disconnect both elements. The torque is transmitted from the main body of the image forming apparatus to the photosensitive drum at the connected state.

The photosensitive drum comprises a cylindrical image carrier made of a conductive material, a bearing portion fixed on both ends of the image carrier, and a supporting pin made of a conductive material which is connected to the bearing portion to carry the image carrier. Since the image carrier and the bearing portion are electrically insulated from each other, an earthing structure for electrically earthing the image carrier is required.

Employed conventionally is an earth plate which comprises a connecting claw electrically connected to the image carrier by contacting with a conductive material portion of the cylindrical image carrier from the inner peripheral wall of the image carrier and a bearing supporting portion receiving a tip end of a supporting pin for carrying a drum in a state where it is brought into sliding contact with the supporting pin. Earth plate is fixed to the image carrier to electrically connect the image carrier and the supporting pin to each other (Japanese Examined Patent Publication No. 4-45828).

In the photosensitive drum earthing mechanism of the foregoing construction, a member on the drum side and a member on the image forming apparatus side are electrically connected to each other by only a contact portion between the bearing supporting portion of the earth plate and the tip end of the supporting pin which are in sliding contact with each other. Therefore, it becomes difficult to obtain a sufficient contact area, resulting in an unstable connected state.

Accordingly, what is really needed is a photosensitive drum earthing mechanism capable of electrically connecting the members on the drum side and the image forming apparatus side to each other reliably.

SUMMARY OF THE INVENTION

The present invention is directed to a photosensitive drum earthing mechanism that satisfies this need.

The photosensitive drum earthing mechanism comprises a novel clutch mechanism for transmitting the torque to a photosensitive drum. The construction makes it possible to electrically connect an image carrier in the photosensitive drum and a member to be earthed in an image forming apparatus to each other in a stable state.

The foregoing and other objects, features, aspects and advantages of the present invention will become more apparent from the following detailed description of the present invention when taken in conjunction with the accompanying drawings.

DESCRIPTION OF PREFERRED EMBODIMENTS

Figure 1:
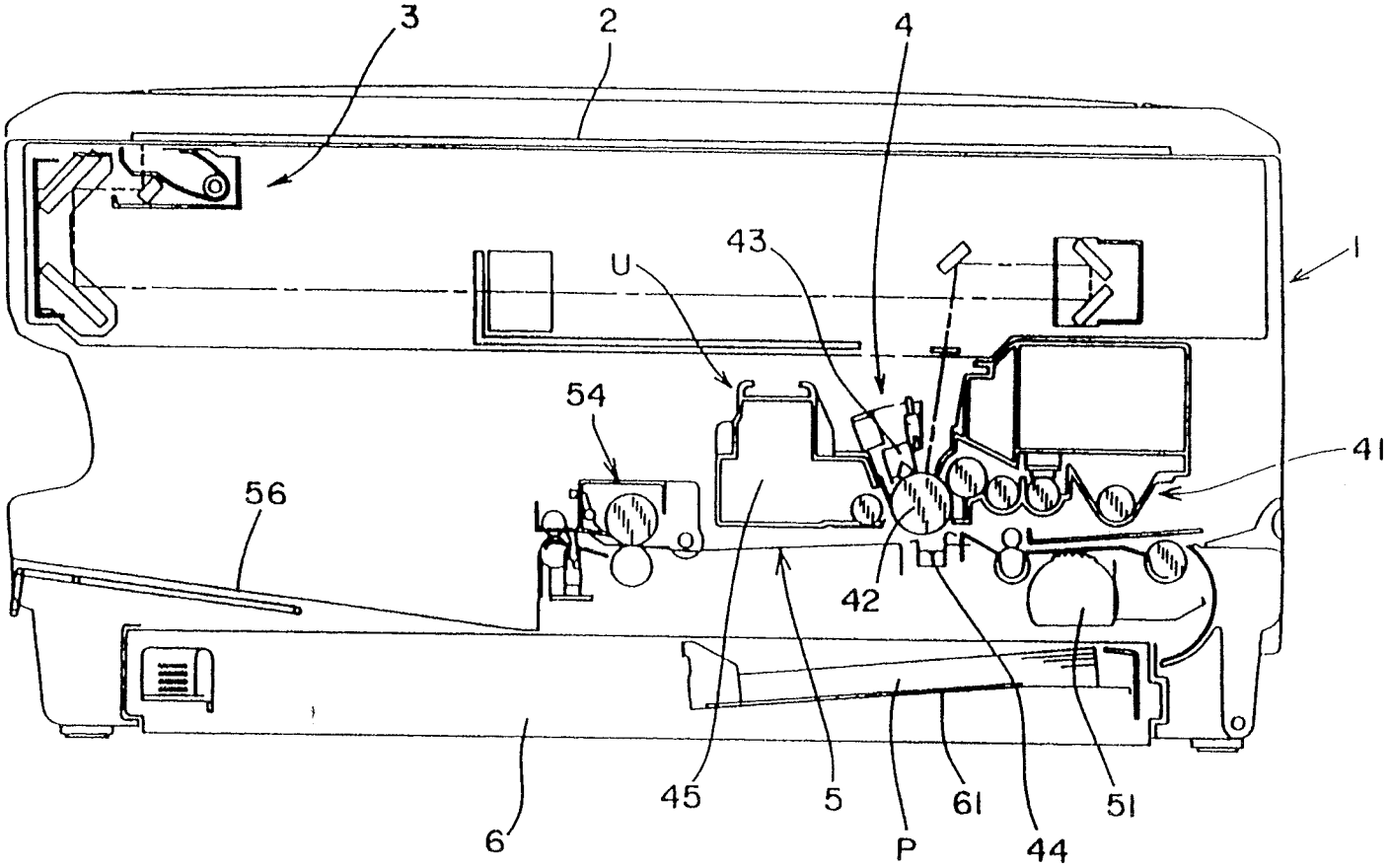
FIG. 1 is a schematic view showing the internal construction of a copying machine in the embodiment.

Referring now to FIG. 1, in a copying machine in an embodiment, the main body of the copying machine 1 comprises an optical system 3 for illuminating and scanning a document put on a transparent platen 2 to introduce reflected light from the document to a photosensitive drum 42; an image forming section 4 which includes the photosensitive drum 42 and develops an electrostatic latent image formed on the photosensitive drum 42 into a toner image by a developing device 41 and transfers the toner image onto paper sheets; and a paper conveying section 5 for conveying a paper through the image forming section 4 to discharge the paper sheets onto a discharge tray 56. Paper conveying section 5 is provided with a fixing section 54 located at an intermediate portion of the paper conveying section 5 and a paper feed roller 51 being semicircular in cross section for pulling the paper sheets out of a paper feed tray 61 in a paper containing section 6 in the main body of the copying machine 1.

In the image forming section 4, a corona discharger 43, the developing device 41, a transferring corona discharger 44, and a cleaning device 45 are disposed in this order around the photosensitive drum 42. The optical system 3 of the image forming section 4 forms an electrostatic latent image from a document image on an outer peripheral surface of the photosensitive drum 42 uniformly charged by the corona discharger 43. The developing device 41 develops the electrostatic latent image into a toner image. The transferring corona discharger 44 transfers the toner image onto the paper sheets. The cleaning device 45 cleans the remaining toner on the photosensitive drum 42.

Figure 2:
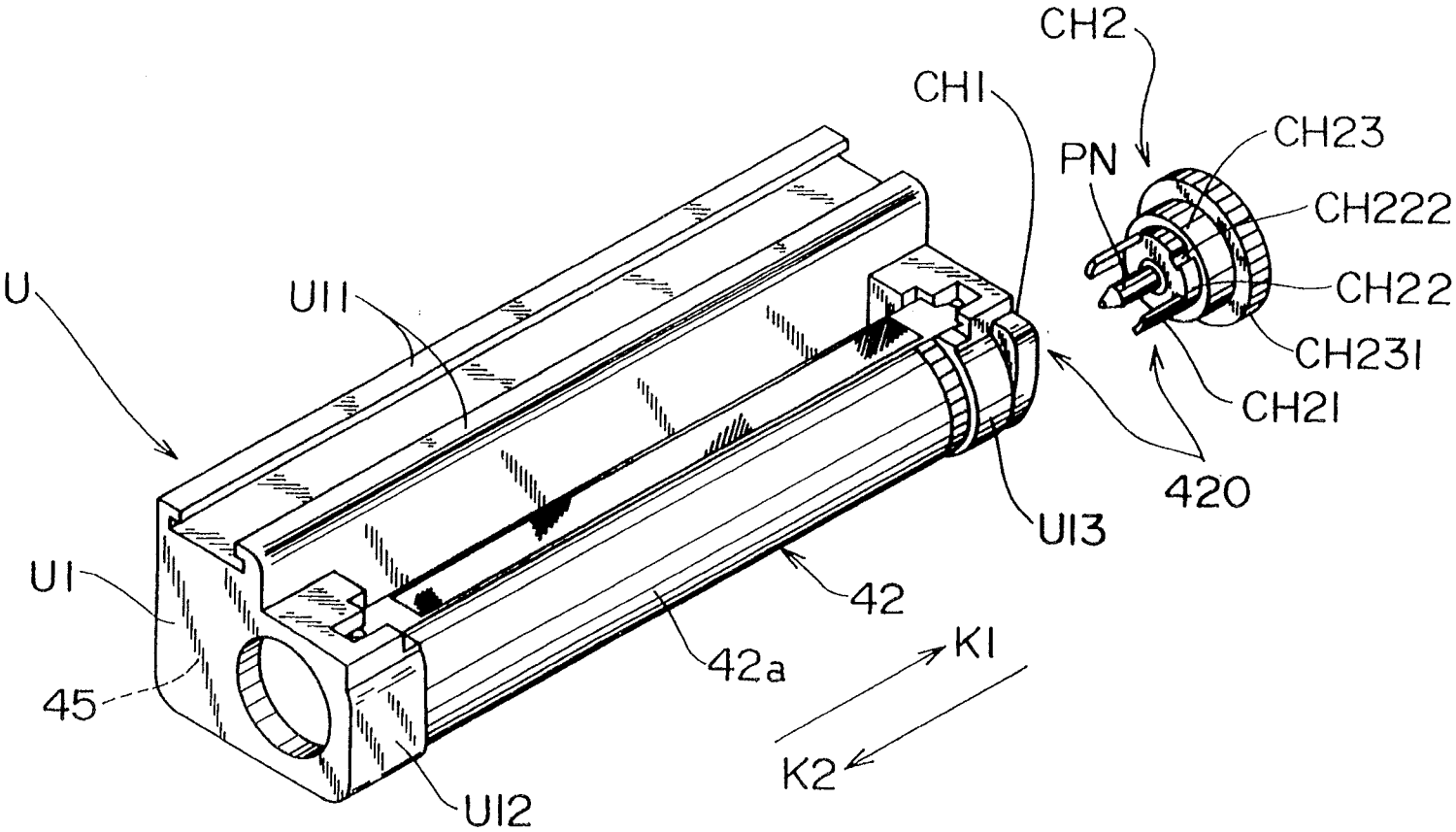
FIG. 2 is a perspective view showing a unit on which a photosensitive drum is mounted.

As clearly shown in FIG. 2, the photosensitive drum 42 in the image forming section 4 is rotatably supported by a unit U.

This unit U comprises a housing U1 which integrally forms the external body of the cleaning device 45. Integrally formed with an upper part of the cleaning device 45 in the housing U1 is a rail U11 which is connected to a guide (not shown) in the main body of the copying machine 1 so that the unit U can be inserted or extracted through an insertion port in the main body of the copying machine 1 (In FIG. 2, the directions of insertion and extraction are, respectively, indicated by arrows K1 and K2).

A pair of supporting portions U12 and U13 is extendingly disposed on the housing U1. The housing U1 is so constructed that both ends of the photosensitive drum 42 are detachably supported by the pair of supporting portions U12 and U13, and the torque is transmitted to the photosensitive drum 42 from a driving mechanism (not shown) in the main body of the copying machine 1 through an engaging clutch 420.

Figure 3:
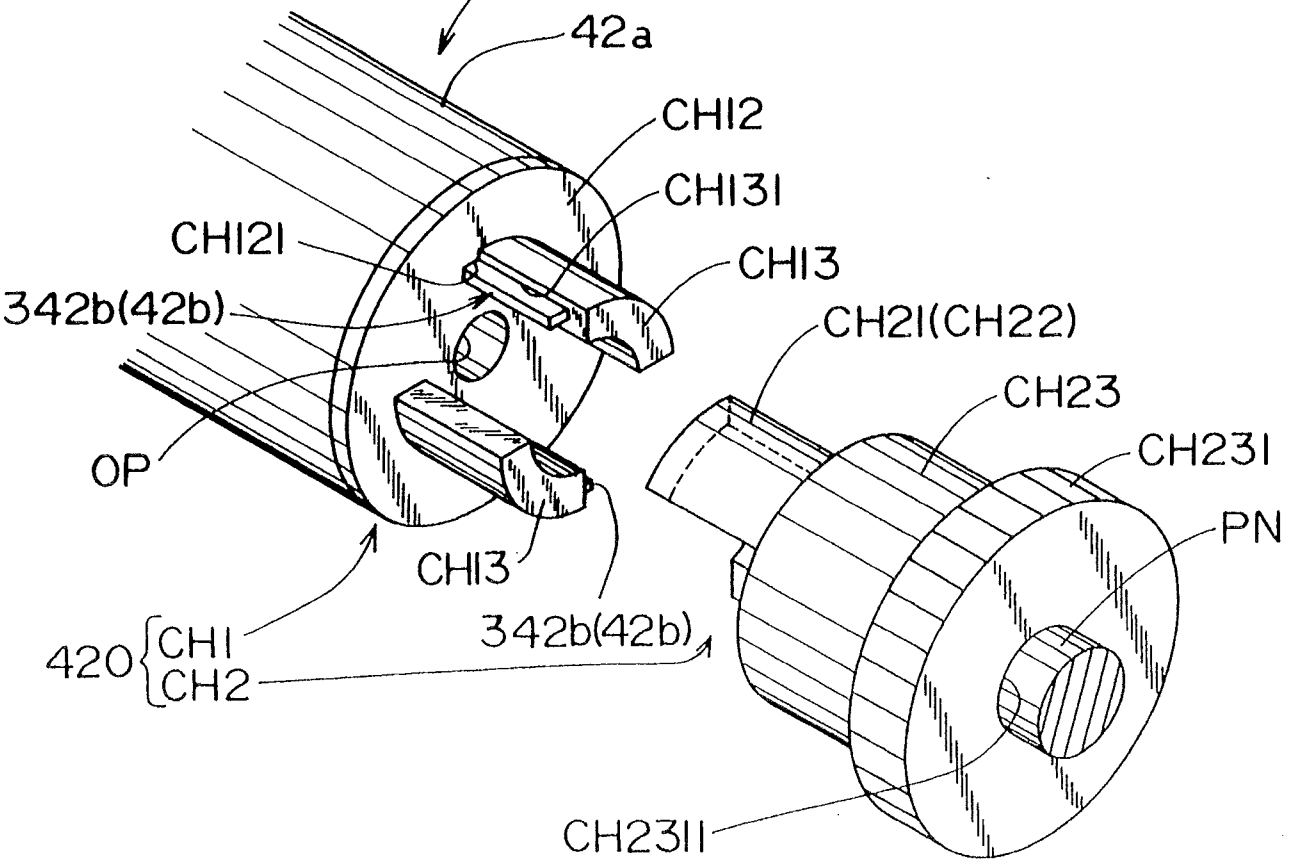
FIG. 3 is an enlarged perspective view showing a principal part of one embodiment of the present invention.
Figure 4:
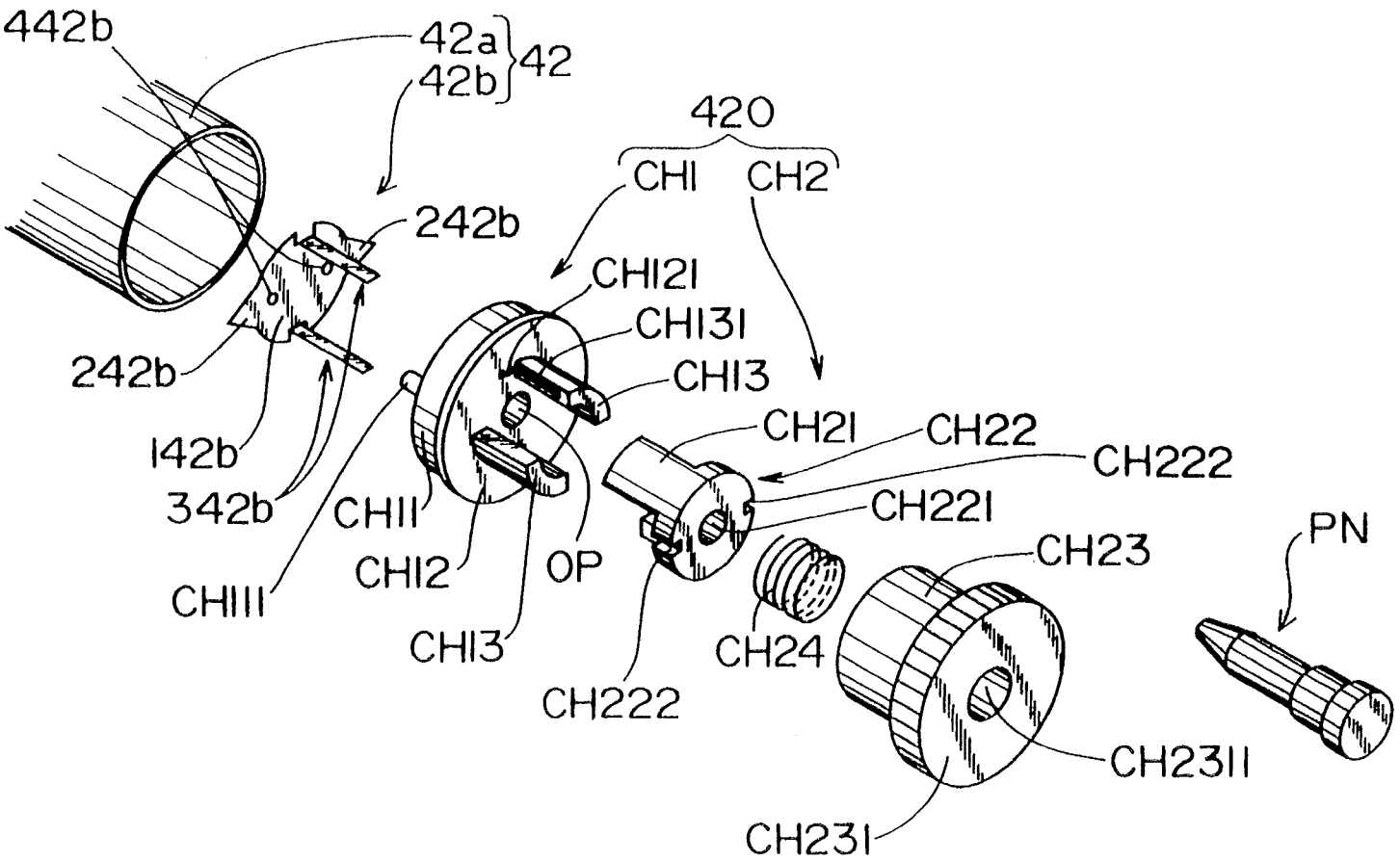
FIG. 4 is an enlarged perspective view showing the photosensitive drum in the embodiment.

Referring to FIGS. 3 and 4, the photosensitive drum 42 comprises a cylindrical image carrier 42*a*. The image carrier or drum part 42*a* is a conductive member made of a light metal such as aluminum.

Referring to FIG. 4, the photosensitive drum 42 comprises an earth plate 42*b* forced to fit into one end of the drum part 42*a*. The earth plate 42*b* is a conductive member integrally formed with a substrate portion 142*b*, connecting claws 242*b* so formed on the substrate portion 142*b* as to extend in the diametral direction of the drum part 42*a*, and long connecting projections 342*b* opposed to each other in a direction orthogonal to the direction in which the connecting claws 242*b* extend and extending outward in the axial direction of the drum part 42*a*. If the substrate portion 142*b* is forced to fit into one end of the drum part 42*a*, the connecting claws 242*b* would cut into the inner wall of the drum part 42*a* through an insulating layer, and the earth plate 42*b* would be electrically connected to a conductive portion of the drum part 42*a* through the connecting claws 242*b*. Formed in the substrate portion 142*b* is a pair of fitting holes 442*b* juxtaposed with each other in the direction in which the connecting claws 242*b* are opposed to each other.

On the other hand, the engaging clutch 420 comprises a drum-side clutch member CH1 fixed to one end of the drum part 42*a* so that the earth plate 42*b* is covered therewith.

The drum-side clutch member CH1 is an insulating resin product which comprises integrally a cylinder portion CH11 forced to fit into the inner wall of the drum part 42*a* in the photosensitive drum 42, a flange portion CH12 on an end surface of the cylinder portion CH11, for positioning the cylinder portion CH11 by contacting with an end surface of the drum part 42*a*, and engaging claws CH13 on the rear surface of the flange portion CH12 and extending in the axial direction of the drum part 42*a*.

The cylinder portion CH11 has the other end surface with which are integrally formed fitting projections CH111 extending to fit in the fitting holes 442*b* of the earth plate 42*b*. Provided in the center of the cylinder portion CH11 or of the flange portion CH12 is a fitting hole OP. Inserted into the fitting hole OP is a supporting pin PN for carrying the photosensitive drum 42.

Furthermore, the flange portion CH12 is provided with through holes CH121 through which the connecting projections 342*b* of the earth plate 42*b* are to be respectively inserted. The through holes CH121 respectively are formed integral with grooves CH131 formed in meshed surfaces in the circumferential direction of the engaging claws CH13. The engaging claws CH13 are a pair of projecting members being a circular arc shape and circumferentially spaced by approximately 90° with respect to the front view. The grooves CH131 are respectively formed on end surfaces in the circumferential direction of the projecting members. Consequently, the connecting projections 342*b* of the earth plate 42*b* are respectively fitted in the through holes CH121 and the grooves CH131, to be exposed to the rear surface of the flange portion CH12, as shown in FIG. 3. As a result, the connecting projections 342*b* are electrically connectable to an engaging claw CH21 in a drive-side clutch member CH2 as described below.

The drive-side clutch member CH2 comprises a slider CH22 integral with the engaging claw CH21, a containing cylinder member CH23 containing the slider CH22 so as to be displaceable only in the axial direction, and a helical compression spring CH24 compressively disposed in the containing cylinder member CH23 for urging the slider CH22 toward the photosensitive drum 42.

The engaging claw CH21 is a member for transmitting the torque to the engaging claws CH13 in the drum-side clutch member CH1, which is embodied by a pair of projecting members being a circular arc, shape and circumferentially spaced by approximately 90° with respect to the front view. In the embodiment, the connecting projections 342*b* of the earth plate 42*b* are respectively fitted in the through holes CH121 and the grooves CH131 to be exposed to meshed parts on the side of the rear surface of the flange portion CH12. Accordingly, the connecting projections 342*b* of the earth plate 42*b* are respectively engaged with the engaging claws CH13 in the drum-side clutch member CH1 in a state where exposed parts of the connecting projections 342*b* are pressed against the engaging claw CH21 in the drive-side clutch member CH2.

The slider CH22 integral with the engaging claw CH21 is an annular member made of metal. Slider CH22 has a center in which is formed a through hole CH221 through which the supporting pin PN is to be inserted. Slider CH22 is further provided with a pair of notches CH222 which are opposed to each other in the diametral direction. The slider CH22 is displaceable in the axial direction relative to the containing cylinder member CH23 while being regulated from relative displacement in the circumferential direction. Gride ribs (not shown) integrally formed on the inner wall of the containing cylinder member CH23 guide the notches CH222. Although it is not specifically illustrated, there is a stopper claw disposed on an opening peripheral end of the containing cylinder member CH23, for preventing the slider CH22 from slipping off. The containing cylinder member CH23 is a resin formed hollow product having a rear surface side with which is integrally formed an input gear CH231. Containing cylinder member CH23 is rotatably supported on the main body of the copying machine 1, for transmitting the torque from an output gear(not shown) of the drive system in the copying machine 1 to the input gear CH231.

The containing cylinder member CH23 is a resin formed hollow product integral with an input gear CH231 on its rear surface, which is rotatably supported on the main body of the copying machine 1. The containing cylinder member CH23 is for transmitting the torque by engaging an output gear (not shown) of a driving system in the main body of the copying machine 1 with the input gear CH231.

Provided in the input gear CH231 is a fitting hole CH2311 in which the supporting pin PN is to be fitted.

The supporting pin PN is a member made of a metal for supporting the photosensitive drum 42 so that the drum-side and drive-side clutch members CH1 and CH2 are aligned with each other by fitting the tip end of the supporting pin PN in the fitting hole OP in the drum-side clutch member CH1 while the intermediate part of the supporting pin PN is being brought into sliding contact with the peripheral surface of the through hole CH221 of the slider CH22. The supporting pin PN is subjected to earthing processing through unshown wiring.

Description is now made of the function of the embodiment.

If the torque produced by the copying machine is transmitted to the input gear CH231 in the drive-side clutch member CH2 from the unshown output gear, the torque is transmitted to the slider CH22 from the containing cylinder member CH23. As a result, the engaging claw CH21 of the slider CH22 rotates the engaging claws CH13 in the drum-side clutch member CH1, so that the photosensitive drum 42 is rotated. In the embodiment, the connecting projections 342*b* of the earth plate 42*b* are electrically connected to the engaging claw CH21 in the drive-side clutch member CH2 by passing through the drum-side clutch member CH1. Accordingly, the photosensitive drum 42 is subjected to earthing processing from the earth plate 42*b* through the drive-side clutch member CH2 which is rotated integrally with the drum part 42*a*.

According to the embodiment, therefore, it is possible to produce such a significant effect that the electrically connected state of the member on the drum side and the member on the image forming apparatus side can be stabilized.

Figure 5:
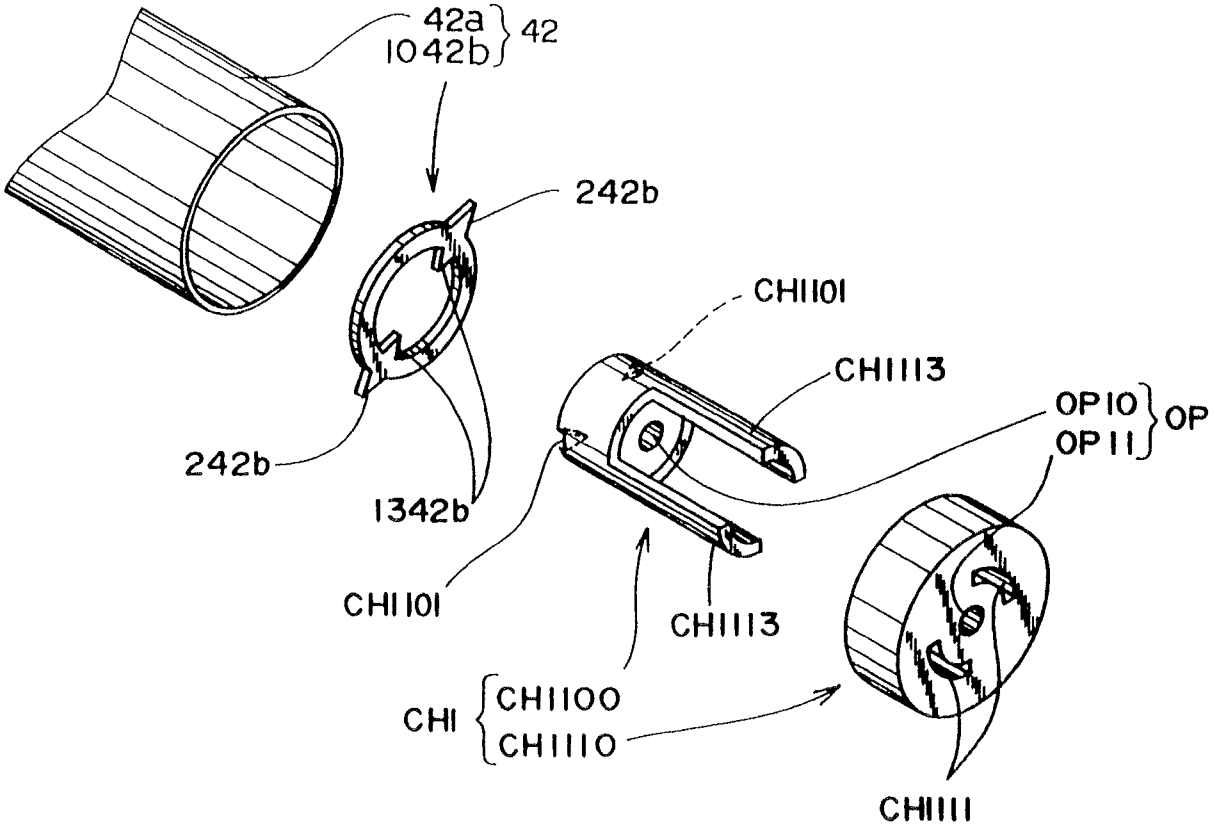
FIG. 5 is an enlarged perspective view showing a photosensitive drum in another embodiment of the present invention.

Referring now to FIG. 5, another embodiment of the present invention will be described in detail.

The embodiment shown in FIG. 5 differs from the embodiment shown in FIG. 3 in the following points:

1) To provide a drum-side clutch member CH1 which is integrally constituted by a flange portion CH1110 made of an insulating material (for example, a resin) which is mounted on the inner periphery of a drum part 42 and an engaging portion CH1100 made of a conductive material which can be electrically connected to a drive-side clutch member (not shown); and 2) To provide an annular earth plate 1042*b* which has a pair of connecting projections 1342*b* for electrically connecting the annular earth plate 1042*b* therethrough to the engaging portion CH1100.

The flange portion CH1110 and the engaging portion CH1100 are integrally formed by placing the flange portion CH1110 together with the engaging portion CH1100. The flange portion CH1110 and the engaging portion CH1100 can be connected to the unshown drive-side clutch member in the circumferential direction by projecting engaging claws CH1113 of the engaging portion CH1100 toward the drive side from through holes CH1111 of the flange portion CH1110. The flange portion CH1110 and the engaging portion CH1100 are respectively provided with holes OP11 and OP10 constituting a fitting hole OP.

The engaging portion CH1100 has the other end in which are formed fitting grooves CH1101. Fitting to the fitting grooves CH1101 are the foregoing connecting projections 1342*b* substantially shaped into triangular claws and are formed on the inner periphery of the earth plate 1042*b*, for electrically connecting the earth plate 1042*b* to the engaging portion CH1100.

Also in the embodiment shown in FIG. 5, the earth plate 1042*b* in the drum part 42 can be connected to the drive-side clutch member through the engaging portion CH1100 in the drum-side clutch member CH1, thus making it possible to produce the same function and effect as those in the embodiment shown in FIG. 3.

Although the embodiments are mere illustrations of preferred examples of the present invention, it goes without saying that various design changes can be made within the range in which the gist of the present invention is not changed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A photosensitive drum earthing mechanism, comprising:

an engaging clutch including a conductive drive-side clutch member and a drum-side clutch member which is fixed to a conductive image carrier in a photosensitive drum and is connectable in a circumferential direction to the drive-side clutch member, the engaging clutch is provided for transmitting torque to the conductive image carrier through the clutch members;

conducting means, provided integrally with the drum-side clutch member, for electrically connecting an inner wall of the conductive image carrier to a conductive portion of the drive-side clutch member; and a supporting pin made of metal and subjected to earthing, wherein the supporting pin has a tip end to be aligned with a fitting hole in the drum-side clutch member through the drive-side clutch member, wherein the supporting pin is electrically connected to the drive-side clutch member at an intermediate part of the supporting pin which rotatably slide contacts the drive-side clutch member.

2. A photosensitive drum earthing mechanism, comprising:

an engaging clutch including a conductive drive-side clutch member to be earthed and an engaging claw, the engaging clutch further including a drum-side clutch member having an insulating engaging claw which is fixed to a conductive image carrier in a photosensitive drum and is connectable in a circumferential direction to the engaging claw of the drive-side clutch member, the engaging clutch provided for transmitting torque to the conductive image carrier through the claws of the clutch members; and conducting means, provided integrally with the drum-side clutch member, for electrically connecting an inner wall of the conductive image carrier to a conductive portion of the drive-side clutch member, wherein the conducting means is disposed on an inner peripheral end of the conductive image carrier and integrally has a connecting projection which passes through the drum-side clutch member in order to be engaged between respective engaging claws of the clutch members so that the connecting projection is electrically connected in the circumferential direction with the engaging claw of the drive-side clutch member.

3. A photosensitive drum earthing mechanism according to claim 2, wherein the conducting means is an earth plate which fits into one end of the conductive image carrier, and the earth plate integrally has a connecting claw which contacts the conductive image carrier.

4. A photosensitive drum earthing mechanism according to claim 3, wherein the earth plate further includes means for regulating displacement in the circumferential direction relative to the drum-side clutch member.

5. A photosensitive drum earthing mechanism according to claim 2, wherein the drive-side clutch member includes a slider which is connectable to the drum-side clutch member, a supporting member is provided for supporting the slider so as to be displaceable only in an axial direction with respect to the photosensitive drum, and a helical compression spring is compressively disposed in the supporting member for urging the slider toward the conductive image carrier.

6. A photosensitive drum earthing mechanism according to claim 5, wherein the slider is an annular metal member integral with the engaging claw of the drive-side clutch member intermittently extending along the same circumferential direction.

7. A photosensitive drum earthing mechanism according to claim 5, wherein the supporting member is a cylinder member which is rotatably supported on a main body of an image forming apparatus and integrally has an input gear on its rear surface.

8. A photosensitive drum earthing mechanism according to claim 5, wherein the drive-side clutch member is brought into sliding contact with a supporting pin made of a metal which is subjected to earthing, wherein the drive-side clutch member is aligned with the drum-side clutch member by the supporting pin.

9. A photosensitive drum earthing mechanism according to claim 2, wherein the conductive image carrier is made of a metal.

10. A photosensitive drum earthing mechanism according to claim 9, wherein the metal is aluminum.

11. A photosensitive drum earthing mechanism according to claim 2, wherein the photosensitive drum is detachably mounted on a unit such that it can be inserted into or extracted from a main body of an image forming apparatus.

12. A photosensitive drum earthing mechanism, comprising:

an engaging clutch including a conductive drive-side clutch member to be earthed and an engaging claw, the engaging clutch further including a drum-side clutch member which is fixed to a conductive image carrier in a photosensitive drum and is connectable in a circumferential direction to the drive-side clutch member, the engaging clutch provided for transmitting torque to the conductive image carrier through the clutch members; and conducting means, provided integrally with the drum-side clutch member, for electrically connecting an inner wall of the conductive image carrier to a conductive portion of the drive-side clutch member, wherein the drum-side clutch member integrally has a flange portion made of an insulating material which is mounted on an inner periphery of the conductive image carrier and an engaging portion made of a conductive material which is electrically and mechanically connectable to the engaging claw of the drive-side clutch member, and the conducting means is disposed on an inner peripheral end of the conductive image carrier and has a connecting projection for electrically and rigidly connecting the drive-side clutch member to the conductive image carrier through the engaging portion of the drum-side clutch member.

13. A photosensitive drum earthing mechanism according to claim 12, wherein the conducting means is an earth plate which fits into one end of the conductive image carrier, and the earth plate integrally has a connecting claw which contacts the conductive image carrier.

14. A photosensitive drum earthing mechanism according to claim 13, wherein the earth plate further includes means for regulating displacement in the circumferential direction relative to the drum-side clutch member.

* * * * *